US007540397B2

(12) United States Patent
Muderlak et al.

(10) Patent No.: US 7,540,397 B2
(45) Date of Patent: Jun. 2, 2009

(54) APPARATUS AND METHOD FOR DISPENSING POST-FOAMING GEL SOAP

(75) Inventors: Kenneth J. Muderlak, Milwaukee, WI (US); Sean Bellinger, Kenosha, WI (US); Rocky Hsieh, Hsin-Chu (TW)

(73) Assignee: Technical Concepts, LLC, Mundelein, IL (US)

( * ) Notice: Subject to any disclaimer, the term of this patent is extended or adjusted under 35 U.S.C. 154(b) by 516 days.

(21) Appl. No.: 10/842,836

(22) Filed: May 10, 2004

(65) Prior Publication Data

US 2005/0247735 A1 Nov. 10, 2005

(51) Int. Cl.
*B65D 35/54* (2006.01)

(52) U.S. Cl. ..... 222/400.5; 222/402.21; 222/333; 251/129.04

(58) Field of Classification Search ..... 222/400.5, 222/402.21–402.23, 333, 321.7–321.9, 373, 222/378, 381, 385, 383.1–383.3; 251/129.04
See application file for complete search history.

(56) References Cited

U.S. PATENT DOCUMENTS

| | | | | |
|---|---|---|---|---|
| 3,165,238 | A | 1/1965 | Wiley | |
| 3,273,752 | A | 9/1966 | Horeczky | |
| 3,732,509 | A | 5/1973 | Florant et al. | |
| 3,739,944 | A | 6/1973 | Rogerson | |
| 3,790,031 | A | 2/1974 | Prussin et al. | |
| 3,952,916 | A | 4/1976 | Phillips | |
| 4,483,466 | A | 11/1984 | Gutierrez | |
| 4,485,943 | A * | 12/1984 | Czech | 222/256 |
| 4,722,372 | A | 2/1988 | Hoffman et al. | |
| 4,790,454 | A * | 12/1988 | Clark et al. | 222/136 |
| 4,815,634 | A | 3/1989 | Nowicki | |
| 4,936,493 | A * | 6/1990 | Foster et al. | 222/209 |
| 5,199,118 | A | 4/1993 | Cole et al. | |
| 5,305,916 | A * | 4/1994 | Suzuki et al. | 222/52 |
| 5,823,390 | A | 10/1998 | Muderlak | |
| 6,125,482 | A | 10/2000 | Foster | |
| 6,276,574 | B1 | 8/2001 | Smrt | |

(Continued)

FOREIGN PATENT DOCUMENTS

| | | | |
|---|---|---|---|
| CN | 1315842 | A | 10/2001 |

(Continued)

OTHER PUBLICATIONS

International Search Report dated Jul. 25, 2005.

*Primary Examiner*—J. Casimer Jacyna
(74) *Attorney, Agent, or Firm*—Dennis J. Williamson; Moore & Van Allen, PLLC

(57) ABSTRACT

An apparatus for dispensing a post-foaming gel soap is disclosed. The dispenser includes a housing containing a first actuator and a second actuator. A motor is operatively connected to said first and second actuator. A circuit is connected to said motor, as well as a sensor assembly and a power supply. In operation, said first and second actuator moves a stem valve and a cylindrical pump located on a reservoir containing a gel soap and an inert propellant gas. The cylindrical pump operates on a piston principle and also closes to prevent any dripping after use. Further disclosed are various methods of accurately dispensing a consistent dose of gel soap.

17 Claims, 11 Drawing Sheets

U.S. PATENT DOCUMENTS

| | | | | |
|---|---|---|---|---|
| 6,607,103 | B2 | 8/2003 | Gerenraich | |
| 2004/0074935 | A1 | 4/2004 | Chon | |
| 2004/0211792 | A1 * | 10/2004 | Vitantonio et al. | 222/333 |
| 2005/0139612 | A1 * | 6/2005 | Matthews et al. | 222/190 |

FOREIGN PATENT DOCUMENTS

| | | | |
|---|---|---|---|
| EP | 0546817 | A1 | 12/1992 |
| EP | 0 546 817 | A1 | 6/1993 |

* cited by examiner

FIG. 5A
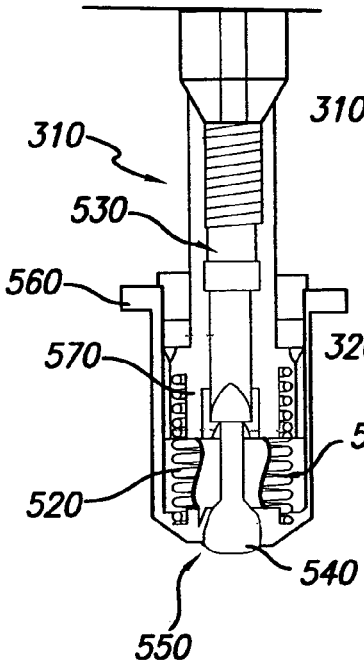
FIG. 5B
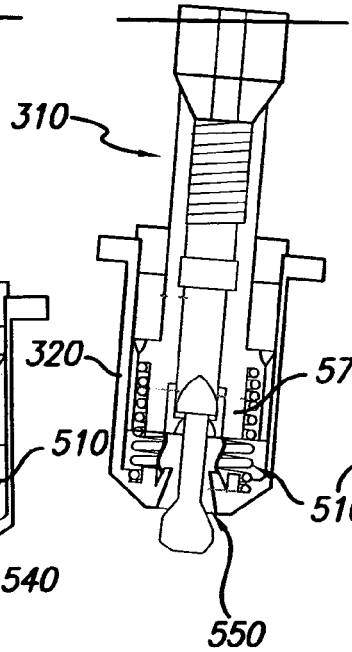
FIG. 5C
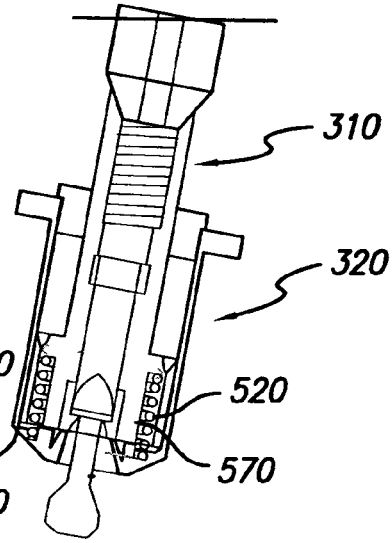
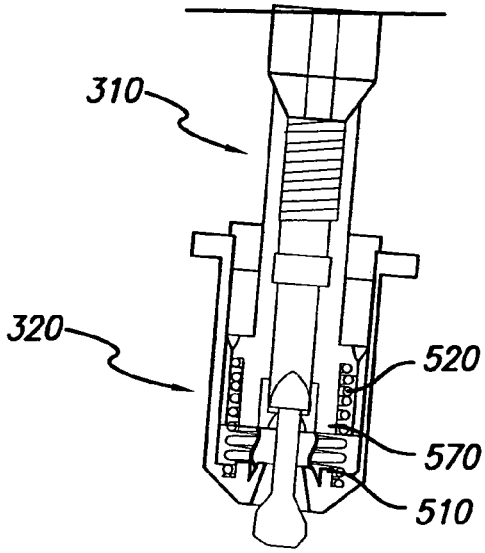
FIG. 5D
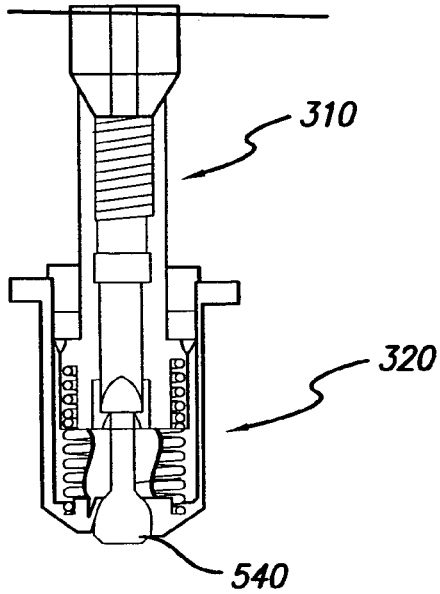
FIG. 5E

APPARATUS AND METHOD FOR DISPENSING POST-FOAMING GEL SOAP

FIELD OF THE INVENTION

The present invention relates to automatic dispensers for soap and, more specifically, to automatic dispensers releasing soap in a gel form, where the gel foams after being released from the dispenser.

BACKGROUND OF THE INVENTION

Traditional soap dispensers have several shortcomings. First, soap dispensers typically require a large amount of space for the soap reservoir. The use of such a dispenser is limited to areas where sufficient space exists. The reservoir can be reduced to accommodate a limited space. However, a smaller reservoir reduces the numbers of doses before the reservoir requires replacement. As a result, a method of dispensing more doses per reservoir is desired.

One method of providing more doses per reservoir is by using a post-foaming gel soap. A post-foaming gel soap is stored in gel form, but converts to foam upon exiting the reservoir. In one method, foaming soap is maintained in a pressurized container. In the pressurized container, the soap remains in gel form. However, when the gel is released from the pressurized container, the change in pressure coverts the gel to foam. A second type of gel foams through the heat created when the user rubs the gel between his or her hands.

Current dispensers for post-foaming gel soap typically allow soap to drip out of the dispenser after a use. This dripping creates an unappealing situation and discourages the use of the dispenser. Therefore, a method of preventing dripping is desired.

Dispensers also often fail to provide a consistent and accurate amount of soap. Most dispensers either do not provide enough soap, or otherwise provide too much soap. Additionally, in pressurized systems, the pressure changes as the amount of soap in the reservoir reduces. This pressure change directly affects the amount of soap dispensed during a use. Therefore, a dispenser that releases a consistent and accurate dose over the lifetime of a reservoir is desired.

Furthermore, the dispensers typically require a person to press a pump or pull a lever on the dispenser. Users who fear that they may contract diseases by the physical contact tend not to use this type of dispenser. In this situation, the usefulness of the dispenser is not completely realized. As a result, touch-free activation is a desired quality in the dispenser.

Many touch-free dispensers require a precise installation above a counter or surface to ensure proper functioning. Therefore, dispenser which assists in its installation is desired.

It is, accordingly, an objective of the present invention to provide a soap dispenser which maximizes the number of effective doses per reservoir.

Another objective is to provide a dispenser that prevents dripping.

Another objective is to dispense a consistent and accurate dose of soap as the supply of soap located in the reservoir reduces.

An additional objective of the present invention is to provide a post-foaming gel soap dispenser that does not require human contact with the dispenser to dispense soap.

It is an additional objective of the present invention to provide a dispenser that assures that it is installed an appropriate height above the counter or surface.

Finally, it is an objective of the present invention to provide a post-foaming gel soap dispenser that is more efficient and less expensive than prior dispensers.

These and other objectives, advantages, and features of the present invention will become apparent from the following description and claims, taken in conjunction with the accompanying drawings.

BRIEF SUMMARY

In one embodiment of the present invention, a dispenser assembly is disclosed. The dispenser assembly is adapted to contain a replaceable soap reservoir. At the bottom of the replaceable soap reservoir is a stem valve. A cylindrical pump is situated below the stem valve. The replaceable soap reservoir contains a gel soap that foams at atmospheric pressure, and an inert gas that serves as a propellant. The dispenser assembly contains a stem valve actuator and a cylindrical pump actuator to activate the stem valve and cylindrical pump respectively. The assembly further contains a motor that provides motion to the stem valve actuator and the cylindrical pump actuator through a reduction gear. A printed circuit board is also present in the assembly and operatively connects to, the sensor and motor. The printed circuit board controls the dispenser.

The circuit is designed to actuate the motor when the presence of a hand is sensed by the sensor assembly. When actuated, the motor rotates the reduction gear, which in turn moves the stem valve actuator and cylindrical pump actuator. When the stem valve actuator moves, it tilts the stem valve in relation to the bottle. The tilting opens the valve, allowing the contents of the reservoir to be in communication with a piston chamber within the cylindrical pump. Simultaneously, the cylindrical pump opens to allow the piston chamber to be in communication with the atmosphere.

The dispenser control logic is designed to accurately dispense the same amount of gel during every use of the dispenser. This logic can have several different embodiments. In the first potential embodiment, the logic is pre-programmed to periodically lengthen the time the dispenser remains open during the lifetime of a reservoir, so that a reduction in pressure in the reservoir does not affect the amount of soap dispensed during the operation of the dispenser. A second embodiment allows for the logic to determine whether an appropriate amount of doses were dispensed for a reservoir, and adjust the dispensing times for the next reservoir. In a third embodiment, the dispenser contains diodes and emitters which detect the level of soap in the reservoir. In this embodiment, the dispenser adjusts the opening time during the lifetime of the reservoir, so that the amount of gel dispensed during each use is consistent. In another embodiment, the logic depends on user input. The logic lengthens the open time when the sensor detects two requests within a predetermined timeframe. Conversely, the logic shortens the open time when no immediately consecutive requests are made in the last ten uses. In these ways, the soap is dispensed in consistent, accurate doses.

In an additional embodiment, the dispenser contains an installation positioning sensor. This sensor aids in the installation by indicating the appropriate height of installation above a counter or other surface.

In another embodiment, a dispenser is disclosed that does not rely upon sensors or motors to actuate the dispenser. In this embodiment, the dispenser is actuated by the user turning a lever or engaging a button. The lever or button moves the stem valve actuator and the cylindrical pump through the reduction gear, and soap is ejected. As a result, the dispenser requires less energy consumption.

BRIEF DESCRIPTION OF THE DRAWINGS

FIG. 5A is a cross-sectional perspective view of the stem valve and cylindrical pump in the rest position;

FIG. 5B is a cross-sectional perspective view of the stem valve and cylindrical pump after their initial movement from the rest position;

FIG. 5C is a cross-sectional perspective view of the stem valve and cylindrical pump in the stall position;

FIG. 5D is a cross-sectional perspective view of the stem valve and cylindrical pump returning to the rest position;

FIG. 5E is a cross-sectional perspective view of the stem valve and cylindrical pump in the rest position after operation;

DETAILED DESCRIPTION PRESENTLY PREFERRED EMBODIMENTS

Figure 1:
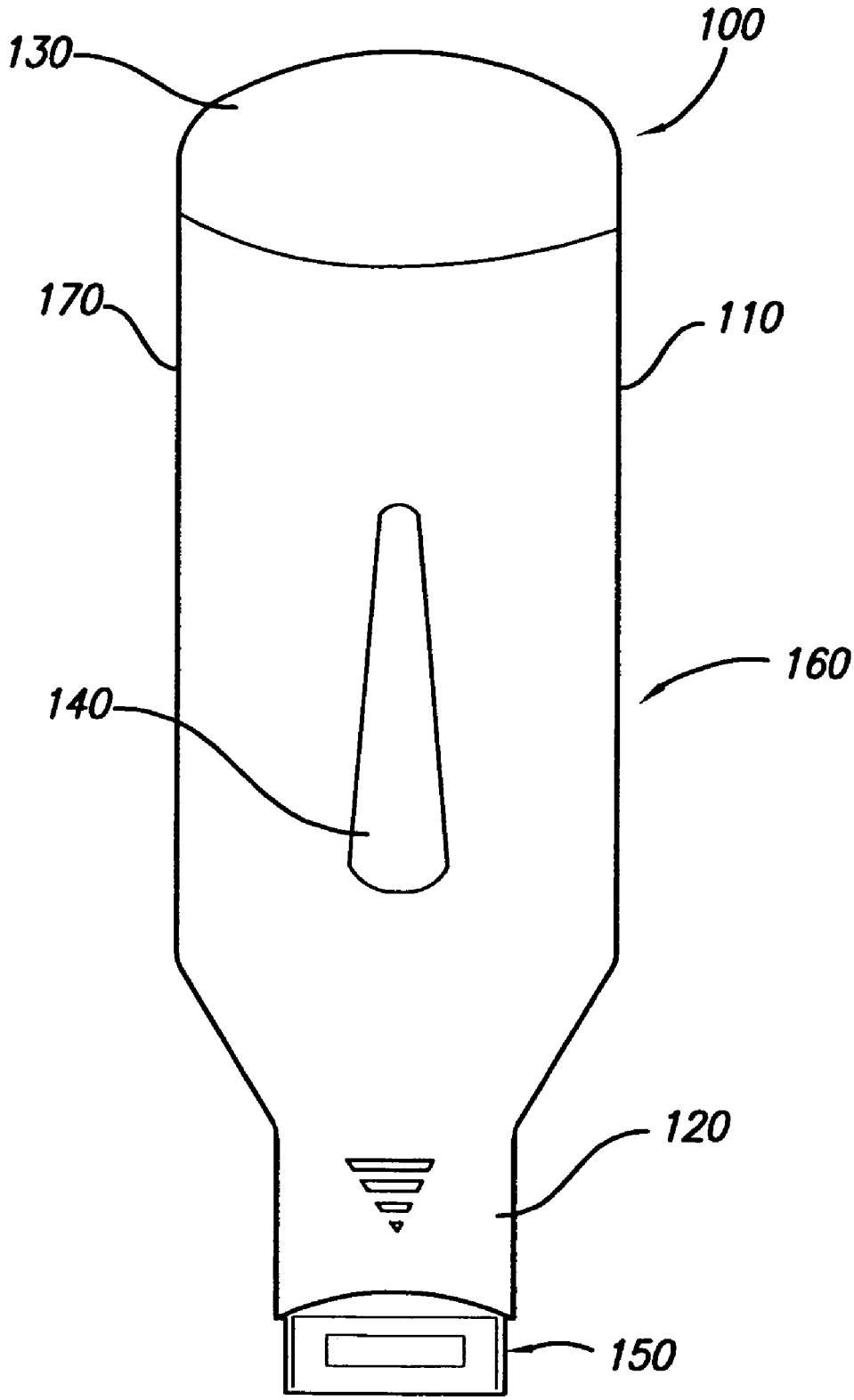
FIG. 1 is a front view of the dispenser assembly.

Referring to FIG. 1, a dispenser assembly 100 is disclosed. The dispenser assembly 100 is designed to contain an actuating mechanism for opening a pressurized reservoir, as well as the reservoir itself. The dispenser assembly 100 has a housing 160 and a housing cover 170. An upper portion 110 of the dispenser assembly 100 is larger than a lower portion 120 of the dispenser assembly 100 to accommodate a reservoir. The dispenser assembly can be made of any durable material, but is preferably constructed of plastic.

The upper portion of the housing cover 170 contains two windows 130, 140. The first window 130 allows for visual access to the to a status indicator of the dispenser. In one embodiment, this indicator is a set of light emitting diodes (LED) which indicate the status of the dispenser. Each LED can indicate whether the power level of the battery is low, whether the reservoir is empty, or whether the dispenser is functioning appropriately, as well as other situations. In another embodiment, the status indicator is a liquid crystal display (LCD) which indicates similar events as the LED. The first window can be made of any durable, clear or translucent material, including clear or translucent plastic.

The second window 140 provides visual access to the reservoir. The second window 140 runs the length of the upper portion 120 of the dispenser assembly 100. In the present embodiment, the dispenser assembly 100 contains a reservoir made of clear or translucent plastic (not shown), so that a person viewing the dispenser assembly 100 can determine the level of soap in the reservoir by viewing the reservoir through the window 140. The second window can be made of any durable, clear or translucent material, including clear plastic.

The lower portion 120 of the dispenser assembly 100 contains a sensor window 150. The sensor window 150 is situated at the bottom of the dispenser assembly 100 and is designed to allow a sensor located within the lower portion 120 of the dispenser assembly 100 to detect the presence of a hand or other object below the dispenser assembly 100. Like the prior windows, 130, 140, the sensor window 150 can be made of any durable, clear or translucent material.

Figure 2:
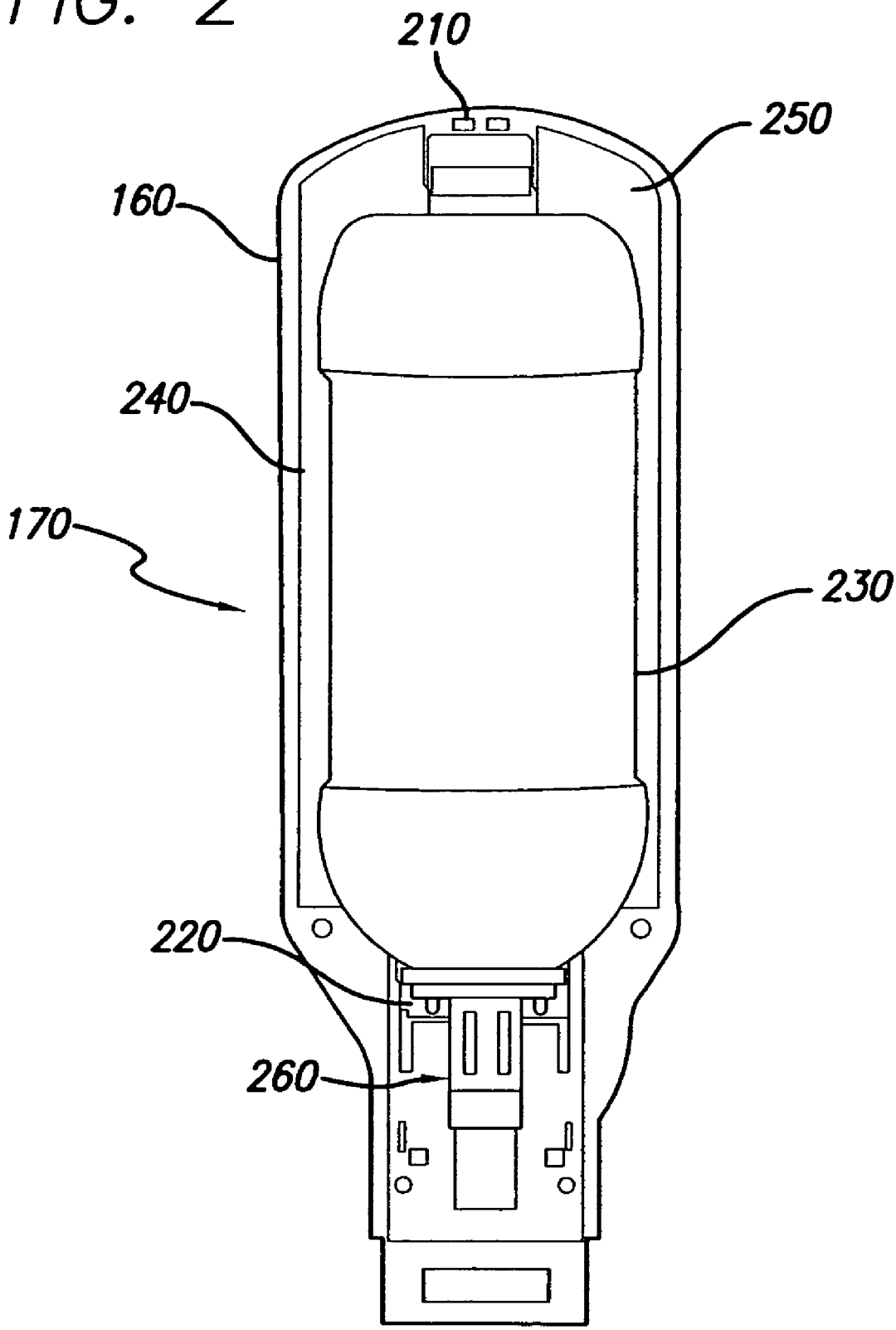
FIG. 2 is a front view of the dispenser with the faceplate removed.

FIGS. 2 displays the dispenser with the housing cover 170 of the dispenser assembly 100 removed. When the housing cover is removed, the dispenser automatically shuts off to ensure that no dosing occurs while maintenance is performed on the dispenser. This situation can be detected my several methods, including a light-sensing element, a lever, or other methods known in the art. When the situation is detected, a break is created to prevent power from being sent to the motor.

The housing 160 contains a clip 210 which holds the housing cover 170 in position when attached. Additionally, the housing 160 contains a reservoir mounting 220. The reservoir mounting 220 allows a reservoir 230 to be securely situated in the dispenser assembly 100. The mounting 220 is designed to allow the reservoir 230 to clip into the mounting 220. The reservoir mounting 220 can be made of any durable material, but is preferably made of plastic.

Figure 2A:
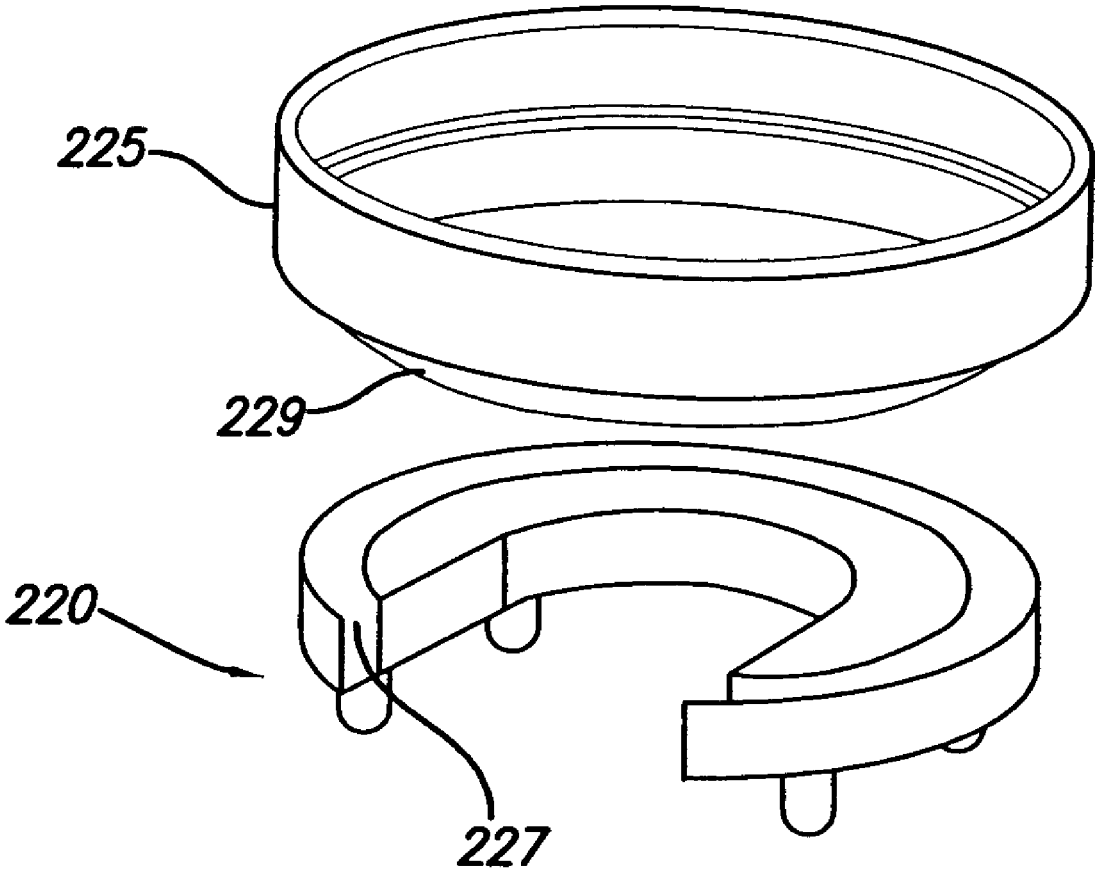
FIG. 2A is an exploded view of the reservoir mounting and attachment ring.

The reservoir mounting 220 is further displayed in FIG. 2A. The reservoir mounting 220 contains a groove 227. FIG. 2A further displays a corresponding attachment ring 225. The attachment ring 225 is fixed to the reservoir. The attachment ring has an extrusion 229 that corresponds to the groove 227, thereby securing the reservoir to the dispenser.

In the present embodiment, a battery pack 240 is present behind the reservoir 230. The battery pack 240 can be designed to contain various numbers and sizes of batteries. In the present embodiment, the dispenser contains four (4) D cell batteries. In an alternative embodiment, the energy source could be an alternating current source and could contain the equipment necessary to use an alternating current source, which is well known in the art.

Below the reservoir 230 and battery pack 240 is a reservoir actuating mechanism 260, which will be later discussed in detail. At the bottom of the housing 160 is the sensor assembly 270. In the present embodiment, the sensor in the lower portion 120 is an infrared (IR) sensor. The IR sensor detects the presence of a hand or other object below the dispenser, in a position to receive a dose of soap. Alternatively, the sensor can be a capacitor, or other sensing device designed to detect an object in the proximity of the dispenser. Above the battery pack is a printed circuit board (PCB) housing 250. The PCB housing 250 contains the circuitry to operate the dispenser. The circuitry is operatively connected to the sensor assembly 270, the battery pack 240, and the reservoir actuating mechanism 260. Near the bottom of the reservoir 230 is an end-of-life sensor 280. In the present embodiment, the end-of-life sensor 280 is a combination of a diode and a photoreceiver. The end-of-life sensor 280 optically senses when the level of soap in the reservoir drops below a predetermined level. When the sensor detects this condition, the sensor sends a signal to the circuitry which then provides an indication to the user that the soap level is low. The indication can be through the LED, or otherwise optical, audible, or any other method of indication.

In the present embodiment, the sensor assembly 270 senses the user or object, and sends a signal to the circuitry. The circuitry then processes the signal and directs power from the battery pack 240 to the reservoir actuating mechanism 260. Then, after a predetermined time, the circuitry cuts the power from the battery pack 240 to the reservoir actuating mechanism. In the present embodiment, the predetermined time may vary from 0.05 seconds to 0.8 seconds depending on the preference on the owner and environmental conditions.

Figure 3:
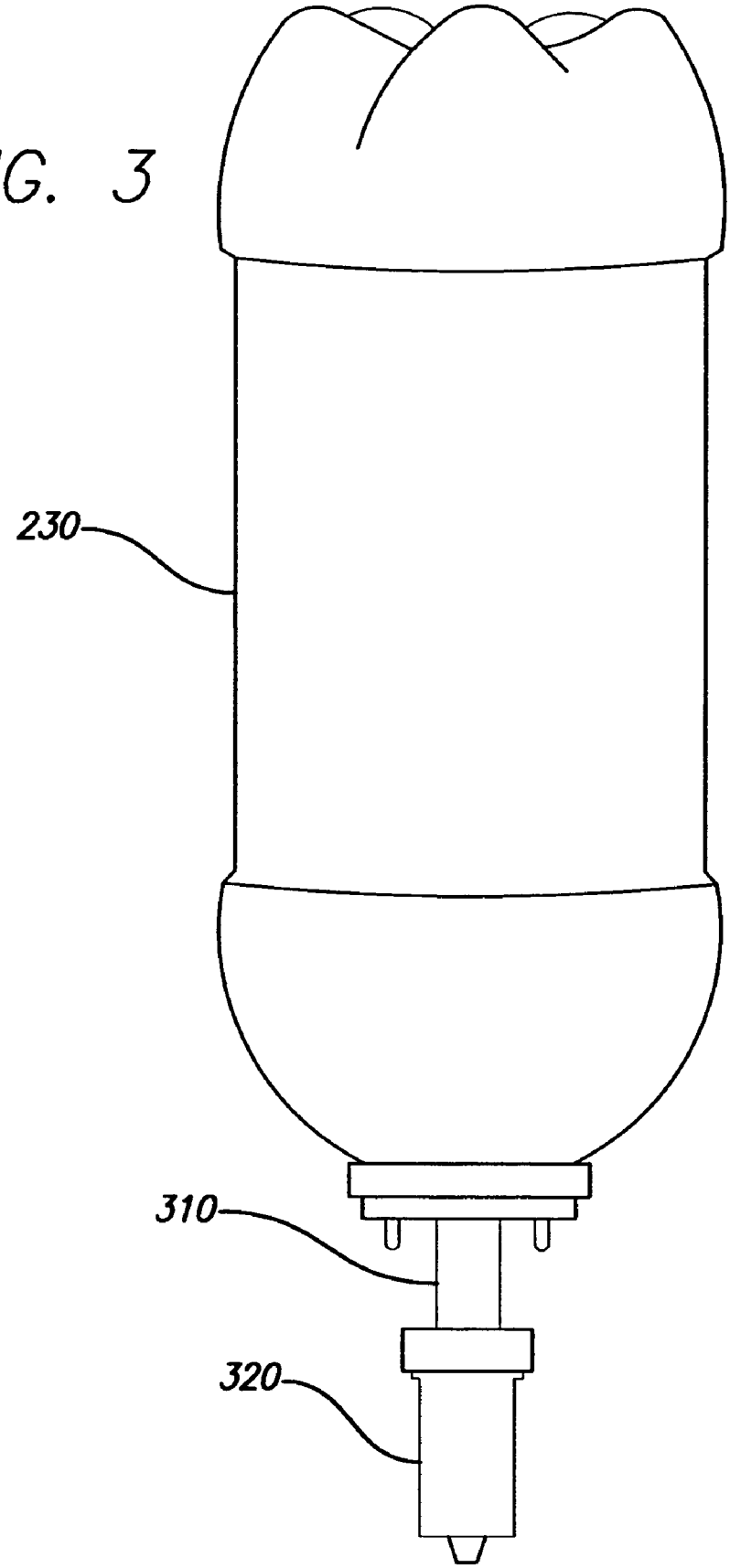
FIG. 3 is a front view of a reservoir, stem valve, and cylindrical pump.

FIG. 3 illustrates a reservoir 230. As previously discussed, the reservoir 230 may be made of a clear or translucent plastic to allow visual inspection of the contents of the reservoir 230 through the second window 140. At the bottom of the reservoir 230 is a stem valve 310. The stem valve 310 is designed to open when the stem valve 310 is tilted with respect to the reservoir 230. The reservoir mounting 220 (FIG. 2) ensures that the reservoir 230 will not move when the stem valve 310 is tilted. In the present embodiment, the stem valve 310 is permanently affixed to the reservoir 230. Below the stem valve 310 is a cylindrical pump 320. The cylindrical pump 320 operates on a piston principle. The cylindrical pump 310 is presently affixed to the stem valve 320 through complementing threading located on both the stem valve 310 and the cylindrical pump 320. In other embodiments, the stem valve 310 and the cylindrical pump 320 can interconnect through clips, adhesives, or other attaching means commonly know in the art.

Figure 3A:
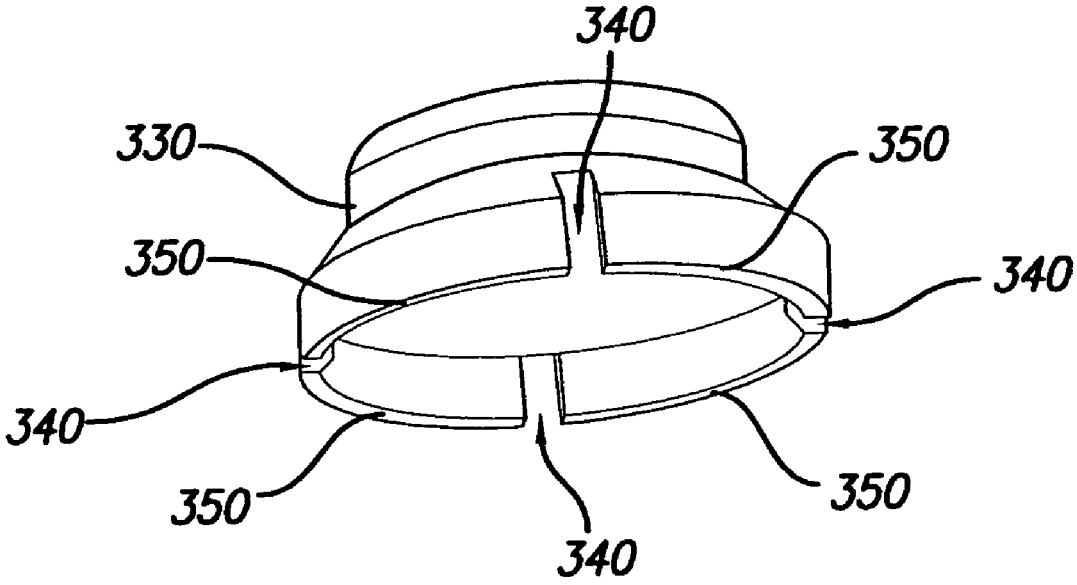
FIG. 3A is a side view of the piston locking ring.
Figure 3B:
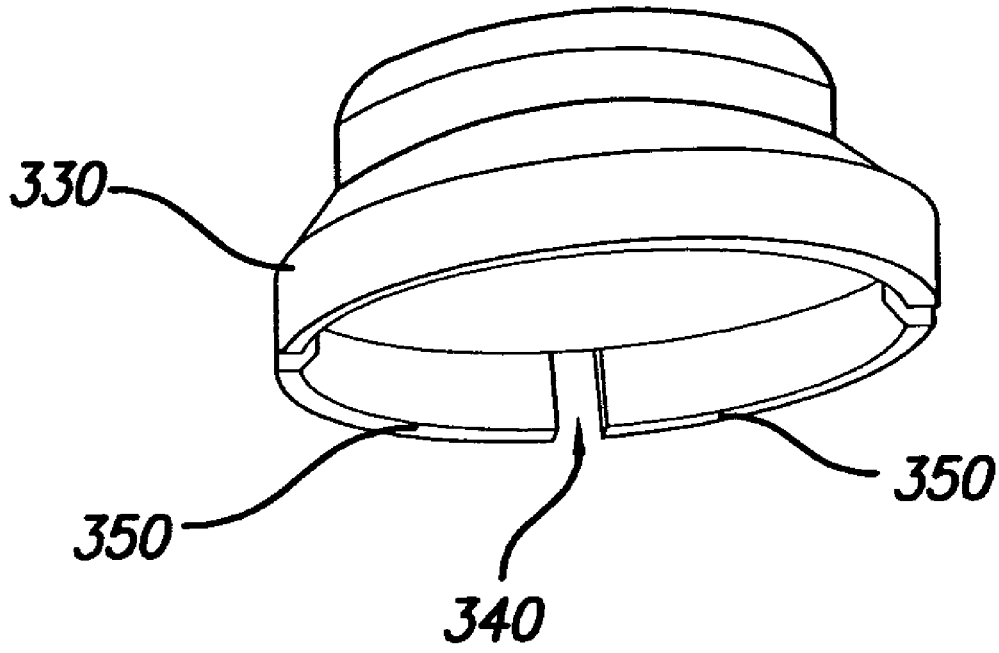
FIG. 3B is a side view of the piston locking ring and cover clip.

FIGS. 3A and 3B show the mechanism which locks the piston to the stem valve and reservoir. In FIG. 3A, the piston locking ring 330 is displayed. The piston locking ring 330 contains four openings 340. The openings 340 are situated between four members 350. The four openings 340 allow the members to easily attach the cylindrical pump 310 to the reservoir. In FIG. 3A, a cover clip 360 is then inserted over the piston locking ring 330 and secured in place to ensure that the piston locking ring 330 holds the cylindrical pump 310 to the reservoir.

Conversely, the cylindrical pump may be permanently affixed to the dispenser. In this embodiment, the stem valve 310 is placed within the cylindrical pump 320 when the reservoir 230 is replaced. As a result, the cylindrical pump 320 is not replaced when the reservoir 230 is replaced.

The reservoir contains a gel soap and an inert, compressed propellant gas. Because of the compressed propellant, the pressure within the reservoir 230 is significantly higher than the atmospheric pressure. In the present embodiment, the pressure in the reservoir 230 prevents the gel soap from foaming. This is based on the principle that the boiling point of the gel is higher when the in a higher pressure. When the stem valve 310 and cylindrical pump 320 are opened, the propellant gas, which is located at the top of the reservoir 230, expands, forcing the gel soap through the stem valve 310 and the cylindrical pump 320 into the atmosphere. Once at atmospheric pressure, the gel soap foams. In an alternate embodiment, the soap may be designed to only foam when subjected to heat, which is typically created by the user rubbing the soap in his or her hands. However, in this method, the inert gas is still used to force the soap out of the reservoir 230.

Figure 4:
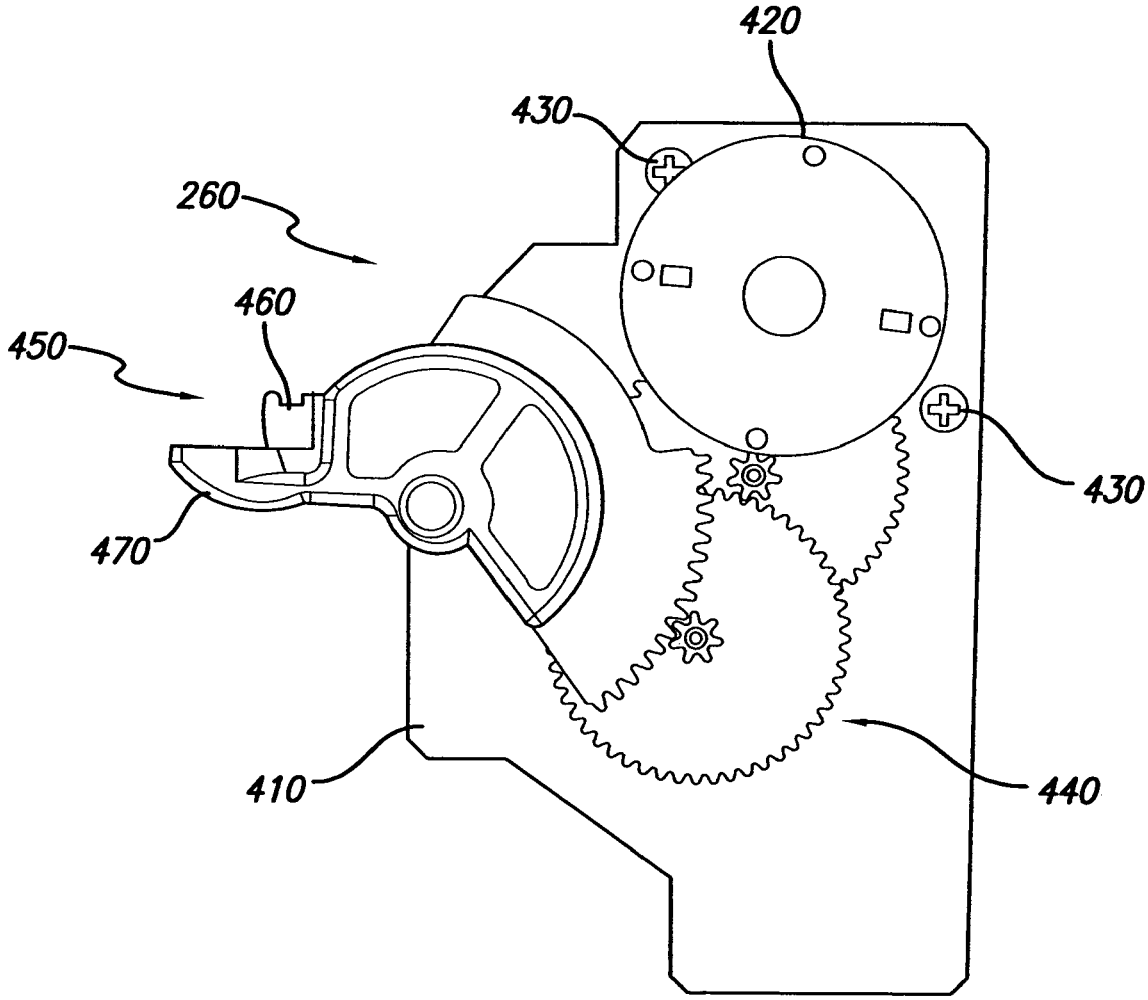
FIG. 4 is a side view of the actuating assembly.
Figure 4A:
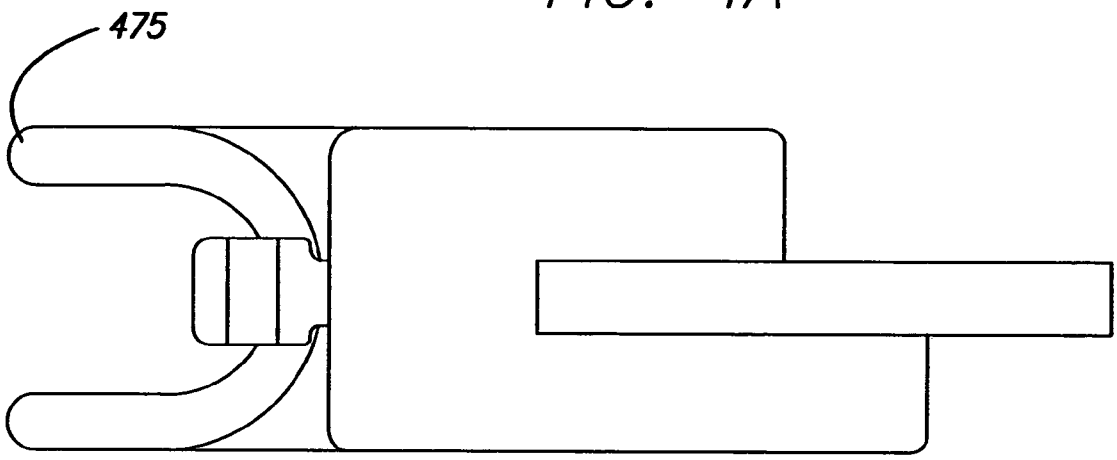

FIG. 4 illustrates the actuating mechanism 260. The actuating mechanism 260 is mounted on a mounting board 410. A motor 420 is secured to the mounting board by two screws 430. A reduction gear train 440 is also attached to the mounting board 410. The reduction gear train 440 operatively connects the motor 420 to a hammer mechanism 450. The hammer mechanism 450 contains both a stem valve actuator 460 and a cylindrical pump actuator 470. In the present embodiment, the cylindrical pump actuator 470 has a "U" shape 475, as shown in FIG. 4A. Conversely, the actuator may be a cam. When the motor 420 begins, the actuating mechanism 260 is activated. The motor 420 is operatively connected to the hammer mechanism 450 through the reduction gear 440. When the motor 420 is activated, it turns the reduction gear 440, which then moves the valve actuator 460 in a tilting motion and the pump actuator 470 in a downward motion.

In operation, the reservoir 230 and the actuating mechanism 260 interact to ensure that a consistent amount of soap is dispensed during each use, and that the reservoir 230 and actuating mechanism 260 prevent drip of excess soap onto the surface or counter. When the sensor assembly 270 senses the presence of a user underneath the dispenser, the sensor sends a signal to the printed circuit board, which subsequently activates the motor 420. The motor 420 in turn rotates the reduction gear train 440. The movement of the reduction gear train 440 moves the hammer in a downward direction. Because the actuating mechanism 260 has a minimal amount of moving parts and moves a minimal amount, the noise created during activation of the dispenser is minimized. Additionally, the minimal amount of moving parts also reduces the likelihood of jamming or malfunction. Additionally, the use of a low torque motor and gears also reduces the noise during actuation.

The dispenser contains circuitry that prevents the dispenser from operating when an objected is continuously in the view of the sensor. If the sensor has detected an object for more than thirty (30) seconds, the dispenser will no longer dispense soap and will begin beeping. To this extent, the dispenser will not continuously dispense soap in a situation where the sensor is blocked.

The movement of the hammer mechanism 450 in the downward direction causes the stem valve actuator 460 against the stem valve 310. The stem valve actuator 460 tilts the valve so that the stem valve 310 opens and the interior of the reservoir is in communication with the cylindrical pump 320. Simultaneously, the cylindrical pump actuator 470 moves in a downward direction against the cylindrical pump 320. The cylindrical pump actuator 470 forces the cylindrical pump 320 to open to the atmosphere.

FIGS. 5A-E display the operation of stem valve 310 and cylindrical pump 320. The stem valve 310 is operatively connected to the cylindrical pump 320. The cylindrical pump 320 operates on a piston principle. The cylindrical pump 320 contains a piston 570 and a piston chamber 510. The cylindrical pump 320 is held in the rest position by a spring 520. The stem valve 310 contains an opening 530 which operatively connects the contents of the reservoir 230 to the cylindrical pump 320. The cylindrical pump 320 contains a seal 540, which is closed and seals a piston opening 550 while in the rest position. The cylindrical pump 320 also contains a ledge 560, which is operatively compatible with the cylindrical pump actuator 470.

In FIG. 5A, the stem valve 310 and cylindrical pump 320 are at rest. In this position, the contents of the reservoir 230 are isolated from the piston chamber 510. Additionally, the spring 520 within the piston keeps the piston chamber 510 isolated from the atmosphere, by maintaining the seal 540 against the piston opening 550. As a result, the contents of the reservoir 230 are completely separated from the atmosphere.

In FIG. 5B, the hammer mechanism 450 is actuated, and begins to tilt the stem valve 310 and push the cylindrical pump 320 in a downward direction. In this position, the stem valve 310 opens to the piston chamber 510 of the cylindrical pump 320. Additionally, the bottom of the piston chamber 510 of the cylindrical pump 320 opens. As a result, the pressurized soap in the reservoir 230 begins to fill the piston chamber 510 of the cylindrical pump 320. If the piston chamber 510 of the cylindrical pump 320 completely fills, any volume of soap beyond the volume of the chamber gel soap is ejected into the user's hands.

In FIG. 5C, the hammer mechanism 450 is in the stall position. In this position, the stem valve 310 is completely tilted, and the piston chamber 510 is open to the atmosphere. In this position, the spring 520 in the cylindrical pump 320 is completely compressed and the piston 570 contacts the bottom of the piston chamber 510, forcing all of the gel soap that was in the piston chamber 510 out of the cylindrical pump 320. The stem valve 310 and cylindrical pump 320 may remain in this position for a short period. During that period, the pressure in the reservoir 230 continues to force gel soap out of the reservoir 230 and into the hand of the user. As a result, the amount of soap dispensed to the user directly depends on the amount of time that the dispenser remains in the stall position.

FIG. 5D displays the stem valve 310 and cylindrical pump 320 when they are returning to the rest position after energy has been cut to the motor. In this position, the valve stem 310 is closing and therefore eliminates the flow of soap out of the reservoir 230. Simultaneously, the energy stored in the spring forces the piston 570 in the cylindrical pump 320 to lift, thereby creating a vacuum in the piston chamber 510 and pulling some gel soap back into the piston chamber 510. Additionally, the cylindrical pump 320 forces the hammer mechanism 450 back to its rest position.

In FIG. 5E, the stem valve 310 and the cylindrical pump 320 are again at rest. In this position, the soap that has not been ejected into the hand of the user has been pulled back into the piston chamber 510 of the cylindrical pump 320. The seal 540 on the cylindrical pump 320 is also closed, thereby preventing the soap currently located in the piston chamber 510 from dripping. As a result, the dispenser provides a dose without allowing dripping.

The amount of soap dispensed is directly proportional to the amount of time that the stem valve 310 and cylindrical pump 320 are open. The longer the stem valve 310 and cylindrical pump 320 are open, the more soap is dispensed. As a result, the amount of soap dispensed can be modified by adjusting the amount of time that the stem valve 310 and cylindrical pump 320 are open.

The dispenser further ensures a consistent dose through its dispensing methodology. When a new reservoir 230 is placed into the dispenser, the circuitry is notified of the new reservoir 230. The person replacing the reservoir 230 can manually perform this notification, or the notification can be a switch or other actuator that is engaged when the reservoir is replaced. At the beginning of the lifetime of the reservoir 230, the pressure within the reservoir 230 is high. As a result, when stem valve 310 and cylindrical pump 320 are open, the soap exits the dispenser at a high rate. Therefore, the time that the stem valve 310 and cylindrical pump 320 must remain open is short. As the amount of soap in the reservoir 230 decreases, the gas expands. As a result, the pressure within the reservoir 230 decreases. With the decreased pressure, the rate at which soap exits the reservoir 230 when the stem valve 310 and cylindrical pump 320 are open decreases. Therefore, to ensure that a consistent amount of soap is dispensed, the amount of time that the stem valve 310 and cylindrical pump 320 remain open increases. This is accomplished by an increase in the time that the motor is activated. Near the end of lifetime of the reservoir 230, the pressure within the reservoir 230 is at its lowest. As a result, the stem valve 310 and cylindrical pump 320 must remain in the open position for the longest amount of time at the end of the lifetime of the reservoir 230.

In the present embodiment, the circuitry uses a methodology that adjusts the amount of time from approximately 0.05 seconds at the beginning of the lifetime of the bottle to 0.8 seconds at the end of the lifetime of the bottle, and more specifically, in the current embodiment, from 0.16 seconds to 0.31 seconds.

The dispenser also ensures that an accurate amount of soap is dispensed. This methodology can be performed by circuitry. In one embodiment, the circuitry of the dispenser is programmed to periodically increase the time that the stem valve 310 and cylindrical pump 320 are open. The periodic increase of time compensates for the reduced pressure in the reservoir 230, which causes a decrease in the flow rate of the gel soap. The circuitry is not dependent on any input or conditions, but functions on an independent, consistent basis.

In the present embodiment, the reservoir is estimated to have 1000 doses of 0.5 milliliters of gel. The dispenser contains a counter, which counts the number of doses ejected and timing circuitry, which controls the time power is supplied to the motor. When 200 doses of soap are ejected, the timing circuitry lengthens the time that the stem valve 310 and cylindrical pump 320 are open. When 400, 600, and 800 doses of soap are ejected, the time that the stem valve 310 and cylindrical pump are open increases respectively. In the present embodiment, the dispensing time begins at approximately 0.16 seconds and increases incrementally to 0.31 seconds.

In a second embodiment, the circuitry is programmed with a desired number of doses for a reservoir 230. The dispenser again contains a counter that counts the actual number of doses that a reservoir 230 provides during its lifetime. If the actual number is less than the desired number, the timing circuitry reduces the time that the stem valve 310 and the pump 320 are opened per dose for the next reservoir 230. Conversely, if the actual number is greater than the desired number, the timing circuitry increases the amount of time that the stem valve 310 and the cylindrical pump 320 remain open per dose for the next reservoir 230. In the present embodiment, each reservoir contains approximately 1000 desired doses. The counter then counts the actual number of doses dispensed prior to the bottle being replaced. The timing circuitry then adjusts the dispensing time accordingly.

Figure 6:
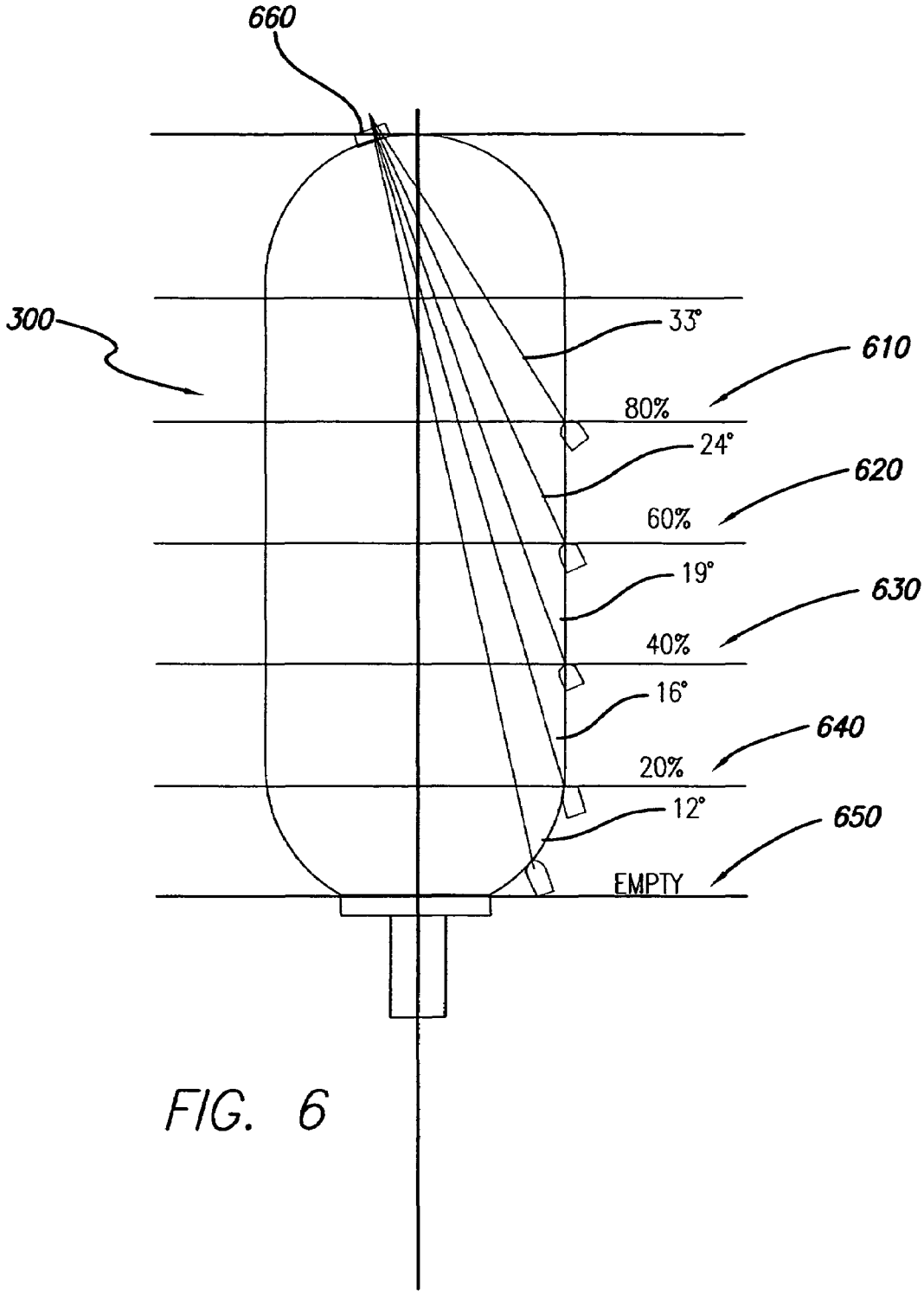
FIG. 6 is a cross-sectional view of the reservoir and emitters and photoreceivers.
Figure 7:
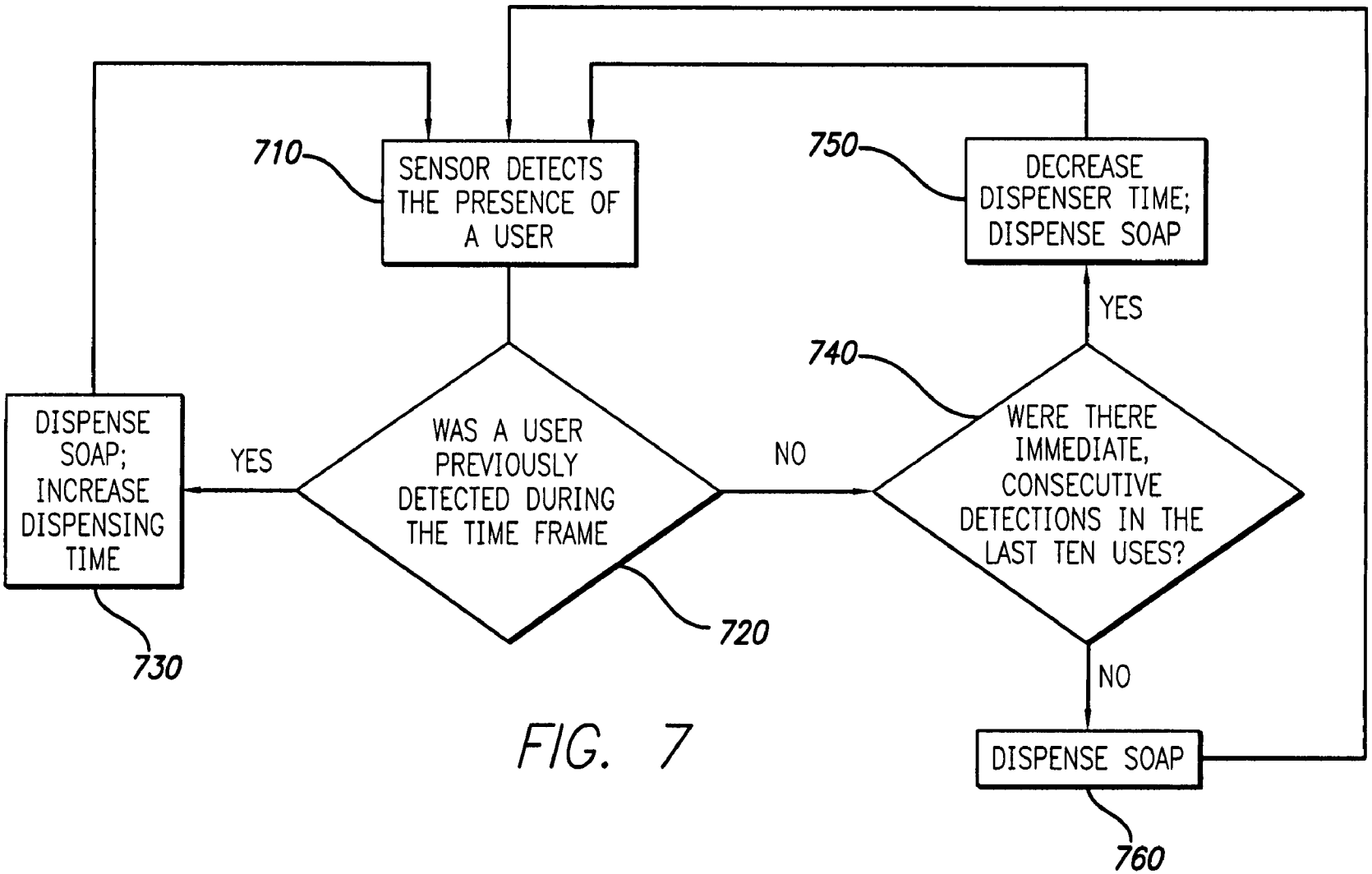
FIG. 7 is a block diagram displaying the circuitry logic for dose adjustment based on human interaction.

In another embodiment, as indicated in FIG. 6, the dispenser contains emitters 610, 620, 630, 640, 650 and a photoreceiver 660. The emitters 610, 620, 630, 640, 650 are situated to send a signal when the soap drops below a certain level. In the present embodiment, five emitters are located at the 80%, 60%, 40%, 20% and empty. The circuitry has an anticipated number of doses for each fifth of the gel soap in the reservoir 230. In the present embodiment, each fifth of the reservoir contains an anticipated 200 doses. When the 80% emitter 610 is detected, the actual number of doses is compared to the anticipated number of doses, and the circuitry adjusts the dispensing time accordingly. If the number of actual doses is greater than 200, the time is increased. Conversely, if the actual number is less than 200, the time is decreased. As a result, this embodiment allows the dispenser to adjust the dispensing time during the lifetime of one reservoir 230.

In a final embodiment, the time is adjusted through interaction with the user. When a user requests a dose 710, the circuitry, determines whether a dose had previously been requested in a predetermined timeframe 720. The timeframe is established so that the two requests are likely to be made by the same user who was not satisfied with the amount of the first dose. For example, if two requests are made in a 2 second timeframe, it is probable that the same user made the requests. If there were two requests in the predetermined timeframe, the circuitry lengthens the time that the stem valve 310 and cylindrical pump 320 are open 730. Conversely, if there was not a prior request within the timeframe, the circuitry determines whether the prior ten requests were within a timeframe of a consecutive request 740. If there are no two requests that are within a common timeframe, the circuitry decreases the dose time 750. Conversely, if two requests of the prior ten requests were made in a common timeframe, the dose time will not be altered 760. As a result, the dose time is continuously adjusted to ensure a precise amount of soap is dispensed.

Additionally, in the present embodiment, the operator of the dispenser can have the ability to adjust the dose size linearly; either upwardly or downwardly. As a result, the automatic adjustments will continue to operate as previously disclosed, but will be linearly adjusted based upon the operator's desires. This operator adjustment can be performed at any time, and does not depend on the status of the reservoir.

When being installed, the dispenser may have the ability to accurately determine the distance between a counter or surface and the dispenser. This ensures that the dispenser is positioned at an optimal height. More specifically, the dispenser contains a sensor which detects the surface below the dispenser. When the dispenser is too close to the surface, the dispenser outputs a first signal. This first signal may be visual or audible. For example, the signal may be an up arrow, a first tone, or a first rate of tones. Conversely, the first signal may be any other method by which the installer can be notified that the dispenser is too low. If the dispenser is too far from the surface or counter, the dispenser will output a second signal. The second output may be a down arrow, a second tone, or a second rate of tones, which will be clearly distinct from the first signal. When this system functions, the dispenser will indicate a first signal when the dispenser is too close to a surface or counter, and indicate a second signal when the dispenser is too far from a surface or counter. As a result, the dispenser will be at a proper distance from the counter or surface when the dispenser is outputting neither the first or second signal. To emphasize this situation, the dispenser may output a third, unique signal, indicating that the appropriate height above the surface or counter has been achieved.

More specifically, the dispenser has a circuitry that is programmed with a predetermined, desired height about the surface or counter. As the dispenser is placed against a wall, a sensor within the dispenser measures the height that the dispenser is above the surface or counter. If the dispenser is too high or too low, the dispenser will indicate the appropriate signal. Using this sensor and circuitry, the dispenser has the ability to determine the appropriate height of the dispenser. In the present embodiment, the sensor is an infrared signal that detects how far the counter or surface is away from the dispenser. The sensor is connected to circuitry that is operatively connected to both a power supply and the output signals that indicate the proximity of the sensor to the counter or surface. This function will be activated only upon request of the installer, and will not be available to the user on a regular basis. Therefore, the mechanism for activating this function is best located where the user does not have access, such as inside the dispenser housing.

In another embodiment, the dispenser does not function automatically, but operates by user interaction. In this embodiment, the dispenser does not contain a sensor assembly 270 or motor 420. In the embodiment, the dispenser contains a lever or other actuator that can be manually operated by the user. The lever or actuator is operatively connected to the reduction gear train, which is operatively connected to the hammer mechanism. As a result, when the lever or actuator is operated, the lever or actuator moves the reduction gear, which in turn moves the hammer mechanism. Therefore, in the present embodiment, the dispenser can be used without the motor or sensor assembly, thereby making the dispenser more inexpensive.

Various embodiments of the invention have been described and illustrated. However, the description and illustrations are by way of example only. Other embodiments and implementations are possible within the scope of the invention and will be apparent to those of ordinary skill in the art. Therefore, the invention is not limited to the specific details of the representative embodiments, and illustrated examples in this description. Accordingly, the invention is not to be restricted except as necessitated by the accompanying claims and their equivalents.

We claim:

1. A dispenser comprising:

a reservoir;

a first actuator for tilting a stem valve on said reservoir;

a second actuator for pushing a cylindrical pump on said reservoir in a downward direction;

a gear assembly operatively connected to said first and second actuators;

a motor operatively connected to said gear assembly;

a power supply in electrical communication with said motor;

a sensor assembly; and circuitry containing logic which receives a signal from said sensor assembly and directs energy to said motor from said power supply, wherein said first actuator comprises a single protrusion that pushes against said stem valve, wherein said second actuator is a "U" shaped protrusion.

2. The dispenser of claim 1 wherein the single protrusion and said "U" shaped protrusion are on a common mounting.

3. The dispenser of claim 2 wherein said single protrusion is located at the base of the "U" shaped protrusion.

4. A dispenser comprising:

a reservoir;

a first actuator for tilting a stem valve on said reservoir;

a second actuator for pushing a cylindrical pump on said reservoir in a downward direction;

a gear assembly operatively connected to said first and second actuators;

a motor operatively connected to said gear assembly;

a power supply in electrical communication with said motor;

a sensor assembly; and circuitry containing logic which receives a signal from said sensor assembly and directs energy to said motor from said power supply, wherein said circuitry controls an amount of time that said power supply provides energy to said motor, wherein said circuitry adjusts an amount of time that said power supply provides energy to said motor through a lifetime of said reservoir based upon results detected during a lifetime of a previous reservoir.

5. A dispenser comprising:

a reservoir;

a first actuator for tilting a stem valve on said reservoir;

a second actuator for pushing a cylindrical pump on said reservoir in a downward direction;

a gear assembly operatively connected to said first and second actuators; a motor operatively connected to said gear assembly;

a power supply in electrical communication with said motor;

a sensor assembly; and circuitry containing logic which receives a signal from said sensor assembly and directs energy to said motor from said power supply, wherein said circuitry controls an amount of time that said power supply provides energy to said motor, wherein said circuitry adjusts an amount of time that said power supply provides energy to said motor through a lifetime of said reservoir based upon results detected during said lifetime of said reservoir.

6. The dispenser of claim 5 wherein said circuitry adjusts said amount of time that said power supply provides energy to said motor by detecting the level of soap in the reservoir using diodes and a photoreceiver.

7. The dispenser of claim 6 wherein said diodes are located to indicate that said receiver is 80% full, 60% full, 40% full, 20% full, and empty.

8. A dispenser comprising:

a reservoir;

a first actuator for tilting a stem valve on said reservoir;

a second actuator for pushing a cylindrical pump on said reservoir in a downward direction;

a gear assembly operatively connected to said first and second actuators; a motor operatively connected to said gear assembly;

a power supply in electrical communication with said motor;

a sensor assembly; and circuitry containing logic which receives a signal from said sensor assembly and directs energy to said motor from said power supply, wherein said circuitry controls an amount of time that said power supply provides energy to said motor, wherein said circuitry lengthens said amount of time that said power supply provides energy to said motor by detecting whether a user requests two immediately consecutive doses.

9. The dispenser of claim 8 wherein said circuitry shortens said amount of time that said power supply provides energy to said motor by detecting whether the last ten users have not requested two immediately consecutive doses.

10. A dispenser comprising:

a reservoir;

a first actuator for tilting a stem valve on said reservoir;

a second actuator for pushing a cylindrical pump on said reservoir in a downward direction, said second actuator connected to said first actuator; and a gear assembly operatively connected to said first actuator, wherein said first actuator comprises a single protrusion that pushes against said stem valve, wherein said second actuator is a "U" shaped protrusion.

11. The dispenser of claim 10 wherein the single protrusion and said "U" shaped protrusion are on a common mounting.

12. A dispenser comprising:

a reservoir;

a first actuator for tilting a stem valve on said reservoir;

a second actuator for pushing a cylindrical pump on said reservoir in a downward direction, said second actuator connected to said first actuator;

a gear assembly operatively connected to said first actuator; a motor operatively connected to said gear assembly;

a power supply in electrical communication with said motor;

a sensor assembly; and circuitry containing logic which receives a signal from said sensor assembly and directs energy to said motor from said power supply, wherein said circuitry controls an amount of time that said power supply provides energy to said motor, wherein said circuitry adjusts an amount of time that said power supply provides energy to said motor through a lifetime of said reservoir based upon results detected during a lifetime of a previous reservoir.

13. A dispenser comprising:

a reservoir;

a first actuator for tilting a stem valve on said reservoir;

a second actuator for pushing a cylindrical pump on said reservoir in a downward direction, said second actuator connected to said first actuator;

a gear assembly operatively connected to said first actuator; a motor operatively connected to said gear assembly;

a power supply in electrical communication with said motor;

a sensor assembly; and circuitry containing logic which receives a signal from said sensor assembly and directs energy to said motor from said power supply, wherein said circuitry controls an amount of time that said power supply provides energy to said motor, wherein said circuitry adjusts an amount of time that said power supply provides energy to said motor through a lifetime of said reservoir based upon results detected during said lifetime of said reservoir.

14. The dispenser of claim 13 wherein said circuitry adjusts said amount of time that said power supply provides energy to said motor by detecting the level of soap in the reservoir using diodes and a photoreceiver.

15. The dispenser of claim 14 wherein said diodes are located to indicate that said receiver is 80% full, 60% full, 40% full, 20% full, and empty.

16. A dispenser comprising:

a reservoir;

a first actuator for tilting a stem valve on said reservoir;

a second actuator for pushing a cylindrical pump on said reservoir in a downward direction, said second actuator connected to said first actuator;

a gear assembly operatively connected to said first actuator; a motor operatively connected to said gear assembly;

a power supply in electrical communication with said motor;

a sensor assembly; and circuitry containing logic which receives a signal from said sensor assembly and directs energy to said motor from said power supply, wherein said circuitry controls an amount of time that said power supply provides energy to said motor, wherein said circuitry lengthens said amount of time that said power supply provides energy to said motor by detecting whether a user requests two immediately consecutive doses.

17. The dispenser of claim 16 wherein said circuitry shortens said amount of time that said power supply provides energy to said motor by detecting whether the last ten users have not requested two immediately consecutive doses.

* * * * *